US005247310A

United States Patent [19]

Waters

[11] Patent Number: 5,247,310

[45] Date of Patent: Sep. 21, 1993

[54] LAYERED PARALLEL INTERFACE FOR AN ACTIVE ANTENNA ARRAY

[75] Inventor: William M. Waters, Millersville, Md.

[73] Assignee: The United States of America as represented by the Secretary of the Navy, Washington, D.C.

[21] Appl. No.: 903,316

[22] Filed: Jun. 24, 1992

[51] Int. Cl.[5] ..... H01Q 3/22

[52] U.S. Cl. ..... 342/368; 342/372

[58] Field of Search ..... 342/368, 371, 372, 375

[56] References Cited

U.S. PATENT DOCUMENTS

| | | | |
|---|---|---|---|
| 3,878,520 | 5/1975 | Wright et al. | 343/854 |
| 4,028,702 | 6/1977 | Levine | 343/100 |
| 4,583,096 | 6/1986 | Bellman et al. | 343/368 |
| 4,814,774 | 3/1989 | Herczfeld | 342/372 |
| 4,832,433 | 5/1989 | Chapelle et al. | 350/96.15 |
| 4,922,257 | 5/1990 | Saito et al. | 342/377 |
| 4,954,834 | 9/1990 | Buck | 342/360 |
| 4,965,603 | 10/1990 | Hong et al. | 342/372 |
| 5,017,927 | 5/1991 | Agrawal et al. | 342/371 |
| 5,051,754 | 9/1991 | Newberg | 342/375 |
| 5,061,937 | 10/1991 | Ozeki et al. | 342/372 |

OTHER PUBLICATIONS

M. G. Henry et al., "A Producible 94 GHz Detector Circuit for Large-Scale Vidicon Applications," *IEEE Infrared and Millimeter Wave Conference* (Dec. 1987).

Wallington et al, "Optical Techniques for Signal Distribution in Phased Arrays", 645 G.E.C. *Journal of Research,* 2(1984) London, Great Brit.

*Primary Examiner*—Gregory C. Issing

*Attorney, Agent, or Firm*—Thomas E. McDonnell; Edward F. Miles

[57] ABSTRACT

A transmit/receive layer is provided adjacent to an array of antenna elements. The transmit/receive layer has an array of transmit receive modules, each module associated with one of the antenna elements. An analog to digital converter and a digital to optical converter of one of the modules couple an RF signal from the associated antenna element to optical fibers. An optical to RF converter in each of the modules converts an amplitude modulated optical transmit signal from an optical fiber to an RF transmit signal for transmission by the associated antenna element. Frequency down and up converters can be added to perform super heterodyne frequency conversion based on a reference frequency control signal transmitted over the optical fibers. At the ends of the optical fibers opposite to the transmit/-receive layer, a receive layer, a transmit layer, transmit and receive beamforming layers, dedicated signal synthesizer, control signals, and amplitude modulated optical diode lasers and photodiodes are provided. The transmit layer provides an array of amplitude modulated laser diodes, each associated with one of the antenna elements. The receive layer provides an array of receive optical to digital converters coupled to the optical fibers. A matrix of switches selects appropriate signals from the M×N array of parallel receiving beams for subsequent radar target surveillance, tracking, and identification processing.

20 Claims, 6 Drawing Sheets

LAYERED PARALLEL INTERFACE FOR AN ACTIVE ANTENNA ARRAY

BACKGROUND OF THE INVENTION

1. Field of the Invention

The present invention relates to an optical interface for an antenna and, more specifically, relates to an interface having layered characteristics for processing and optically coupling outputs from an array of antenna elements.

2. Description of the Related Art

A conventional type of active antenna array transceiver is illustrated in prior art FIG. 1. A transceiver as illustrated in prior art FIG. 1 is required for each of the antenna elements of an array of antenna elements. Each antenna element 110 is connected thereto by a transmit/receive duplexer 120. The output of the transmit/-receive duplexer 120 connects a receive signal through a low noise amplifier 130 to a port of a transmit/receive switch 140. Another port of a transmit/receive 140 connects a signal to be transmitted through a power amplifier 150 to the transmit/receive duplexer 120. The transmit/receive switch 140 is a double throw single pole switch having its pole connected through a variable phase shifter control 160 and a variable attenuator 170. The transmit/receive switch 140 is controlled to transmit a signal from the variable phase shifter 160 through the power amplifier 150 to the antenna element 110 or, conversely, to receive a signal from the antenna element 110 through the low noise amplifier 130 and the variable phase shifter 160. Therefore, both the variable phase shifter 160 and the variable attenuator 170 are bi-directional. As customary to reduce size and weight, the transceiver illustrated in FIG. 1 is designed to have a minimum number and size of components for interface to each antenna element of the antenna array.

Active phased array antennas are capable of generating an electronically movable radar beam. However, active phased array antennas are very heavy and complex and, thus, have limited utility. Conventionally, a shielded cable or waveguide is necessary for connection to each antenna element of an active phased array antenna. Furthermore, processing circuitry for interface to the active phase array antenna is bulky. Additionally, connection of sometimes close to a thousand shielded cables to the processing circuitry is tedious, error prone and difficult to manufacture and repair. Thus, a small and low cost interface to an antenna array is needed.

SUMMARY OF THE INVENTION

An object of the present invention is to provide an interface for an antenna array capable of solving these and other problems.

Another object of the present invention is to provide an interface for an array of antenna elements capable of using optical fibers to couple an array of antenna elements to processing circuitry. Because a typical optical fiber has a diameter of approximately 100 microns, a significantly smaller bundle of optical fibers is needed for connection to, for example, close to a thousand antenna elements as compared with shielded cable.

A further object of the present invention is to remove phase shifting from the transceiver side of the cable and allow for a more compact transceiver.

Additionally, an object of the present invention is to provide an interface for an antenna array having a plurality of adjacent layers fabricated using photolithographic techniques to achieve low cost, compactness and high reliability.

Furthermore, an object of the present invention is to provide an interface for an antenna array having layers fabricated by photolithographic techniques and a bundle of fiber optic cables attached therebetween.

Moreover, an object of the present invention is to provide an interface for an antenna array having beam forming layers wherein each beam forming layer has an array of processing modules stacked with respect to adjacent beam forming layers.

Additionally, another object of the present invention is to provide an interface for an antenna array having a compact three-dimensional matrix of processors arranged in layers to perform a two-dimensional fast Fourier transform.

A transmit/receive layer is provided adjacent to an array of antenna elements. The transmit/receive layer has an array of transmit/receive modules, each module associated with one of the antenna elements. For reception in the transmit/receive layer, an analog to digital converter in each of the modules converts an RF signal from the associated antenna element into digital signal samples. Digital to optical converters couple each received signal bit to corresponding fibers of a bundle of optical fibers. For transmission by the associated antenna element, an optical to RF converter in each module of the transmit/receive layer converts an amplitude modulated optical signal from one of the optical fibers to an RF transmit signal. Frequency down and up converters can be added to the transmit/receive layer for each module. The frequency down and up converters perform super heterodyne frequency conversion based on a reference frequency signal transmitted by optical amplitude modulation over the bundle of optical fibers.

On the opposite end of the bundle of optical fibers, a receive layer, a transmit layer, dedicated control signals, and RF and intermediate frequency signal amplitude modulated optical diode lasers are provided. The transmit layer has an array of laser diodes, each associated with one of the antenna elements. Adjacent to the transmit layer, an azimuth and elevation RF modulator layer can be provided having an array of corresponding modulators. Furthermore, the receive layer has an array of receive optical to digital converters coupled to the optical fibers. Beam forming layers are provided with an end layer adjacent to the receive layer. The beam forming layers each have an array of processing modules in locations stacked with respect to adjacent beam forming layers. An arrangement (FIGS. 6(*a*) and 6(*b*)) is provided sufficient to perform a two-dimensional fast Fourier transform in a compact low cost layered interface device.

The above-mentioned and other objects and features of the present invention will become apparent from the following description when read in conjunction with the accompanying drawings.

BRIEF DESCRIPTION OF THE DRAWINGS

FIG. 6(*b*) illustrates connections between processors of the beam forming layers.

DETAILED DESCRIPTION OF THE PREFERRED EMBODIMENTS

Figure 2:
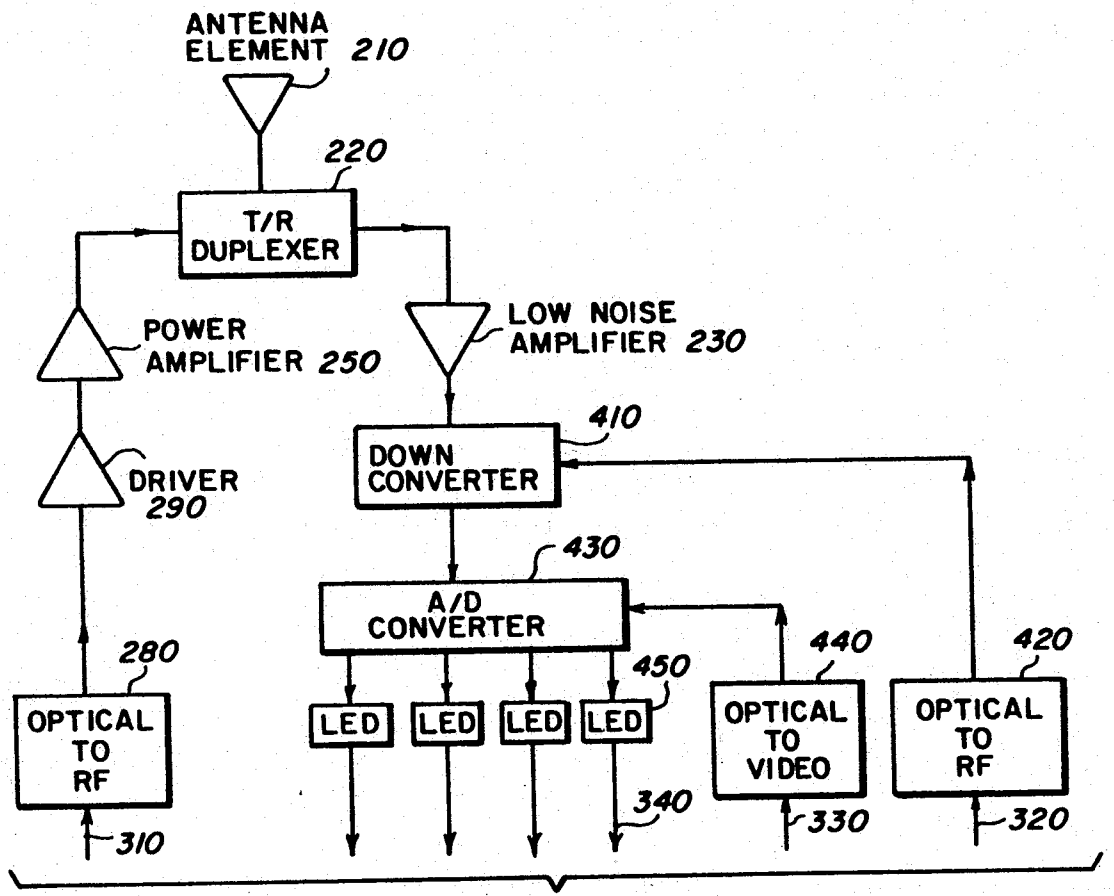
FIG. 2 illustrates a schematic block diagram of the transceiver of one module of a transmit/receive layer connected to an antenna element of an antenna array.
Figure 1:
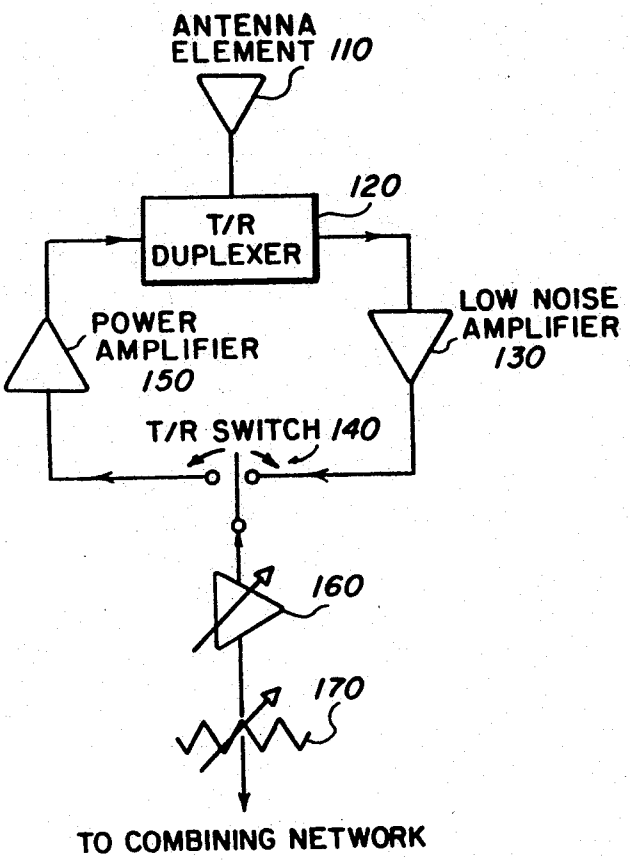
PRIOR ART FIG. 1
FIG. 1 illustrates a schematic block diagram of a prior art transceiver for connection to an antenna element.

FIG. 2 illustrates the transmitter and receiver components necessary for one antenna element of an antenna array. An antenna element 210 is connected by a transmit/receive duplexer 220 to a low noise amplifier 230 for reception and to a power amplifier 250 for transmission. The power amplifier 250 is driven by an optical to RF converter via a driver 290 for transmission. The optical to RF converter 280 converts an analog amplitude modulated optical signal from an optical fiber 310 to an analog RF transmit signal connected to the driver 290. A frequency down converter 410 down converts a frequency of the signal received by the antenna element 210 and amplified by the low noise amplifier 230. Preferably, the frequency down converter 410 is a super heterodyne frequency converter which converts the input signal to an intermediate frequency output based on a reference frequency control signal output from a reference frequency optical to RF converter 420. The reference frequency optical to RF converter 420, like the optical to RF converter 280, converts an analog amplitude modulated optical signal from an optical fiber 320 to the reference frequency control signal. The output of the frequency down converter 410 is connected to an analog to digital converter 430 based on a clock signal from an optical to digital converter 440 connected to an optical fiber 330. The optical to video converter 440 produces a video pulse train for sampling control. The reference frequency optical to RF converter 420 and optical to video converter 440 respectively produce RF control signals and clock signals. Both optical to RF and optical to video converters can be formed by photodiodes; however, they may have different characteristics due to either the analog or pulse signals respectively applied thereto. The analog to digital converter 430 outputs a predetermined number of binary bits. In the example illustrated in FIG. 2, four bits are output to LED digital to optical converters 450 connected to optical fibers 340.

The components of the transmitter and receiver illustrated in FIG. 2 are preferably fabricated in a single transmit/receive layer. These components can be fabricated using photolithographic techniques to produce a low cost layer. The transmit/receive layer is preferably placed adjacent to a layer of an active phased array of antenna elements. The layer of an active phased array of antenna elements is preferably also fabricated by photolithographic techniques such as those known for photolithographic fabrication of L-band cellular telephone type receivers.

Figure 3A:
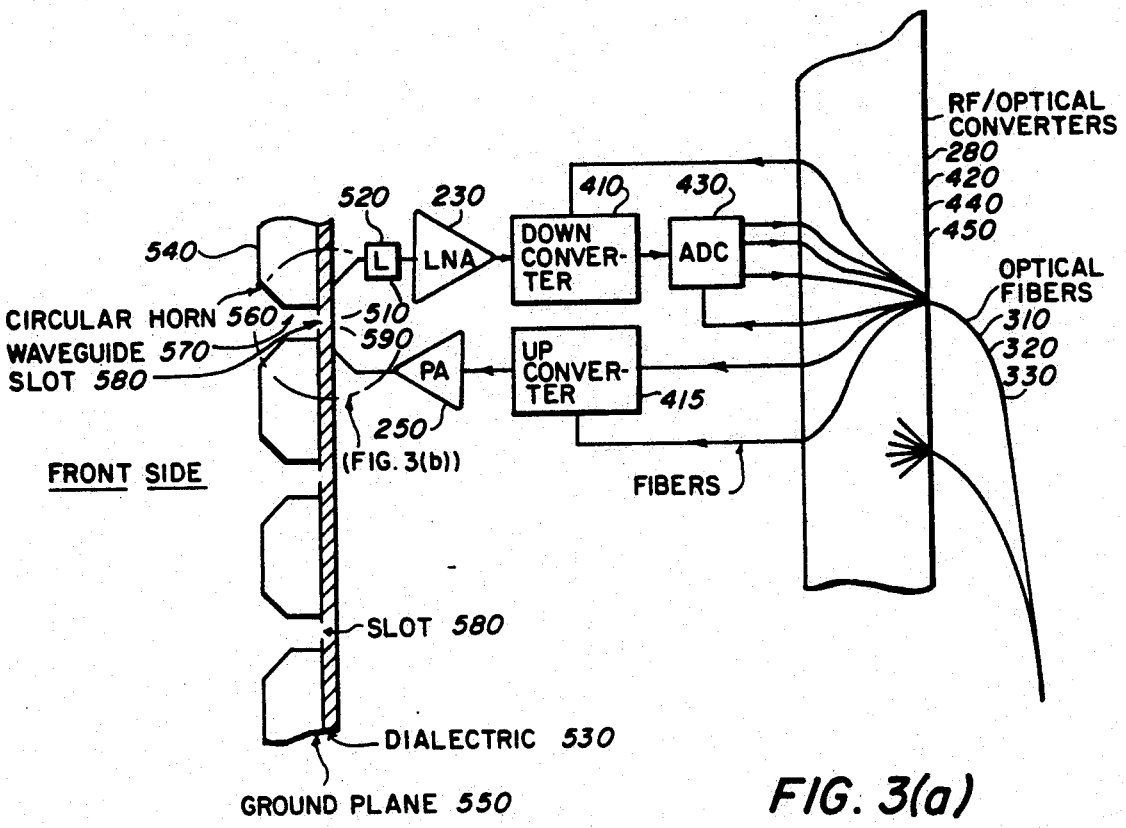
FIGS. 3(*a*) and 3(*b*) illustrate schematic diagrams of a module of the transmit/receive layer for coupling a bundle of optical fibers to an antenna element of an antenna array.
Figure 3B:
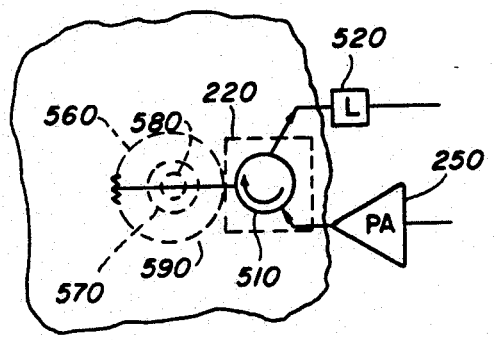

FIG. 3(*a*) illustrates a cross section of an array of antenna elements and the components of a module of a transmit/receive layer for one antenna element of the array of antenna elements. FIG. 3(*b*) illustrates an exploded side view of a portion of FIG. 3(*a*). A microstrip circulator 510, best illustrated in FIG. 3(*b*), duplexes an antenna slot 580 to the limiter 520 and the power amplifier 250 via the microstrip 590. A microstrip 590 is configured orthogonal to a slot 580 in a ground plane 550. Antennas are formed in foam or other lightweight material 540. In the case of foam 540, surfaces of circular horns 560 and wave guides 570 must be metalized; the ground plane of the end of the waveguides 570 contains a slot 580 of each antenna element. The circular horns 560 resemble counter sunk holes when viewed from the front side. The ground plane 550 is on the front side of a dielectric 530 as illustrated in FIG. 3(*a*). The dielectric 530 and the ground plane 550, having the slot 580 therein, can be photolithographically fabricated.

Microstrip 590 and ferrite circulator 520 are connected via the microstrip circulator 510 to the low noise and power amplifiers 230 and 250, respectively. The low noise amplifier 230 connects through the down converter 410 to the analog to digital converter 430 and the optical fibers via the optical converters. Furthermore, on the transmit side, a frequency up converter 415 can optionally be provided if frequency up conversion of the optical receive signal from the optical to RF converter 280 is desired. A reference frequency control signal can be obtained from a reference frequency optical to RF converter such as optical to RF converter 420 in FIG. 2.

Each of the antenna elements has a module of circuitry associated therewith such as that illustrated in FIG. 3(*a*). In an antenna array having, for example, as many as one thousand antenna elements, one thousand modules of circuitry like that illustrated in FIG. 3(*a*) will be required. That is, fabrication by photolithographic techniques and use of optical fibers provides for a sufficiently compact transmit/receive layer that may be placed adjacent to the antenna array.

Figure 4:
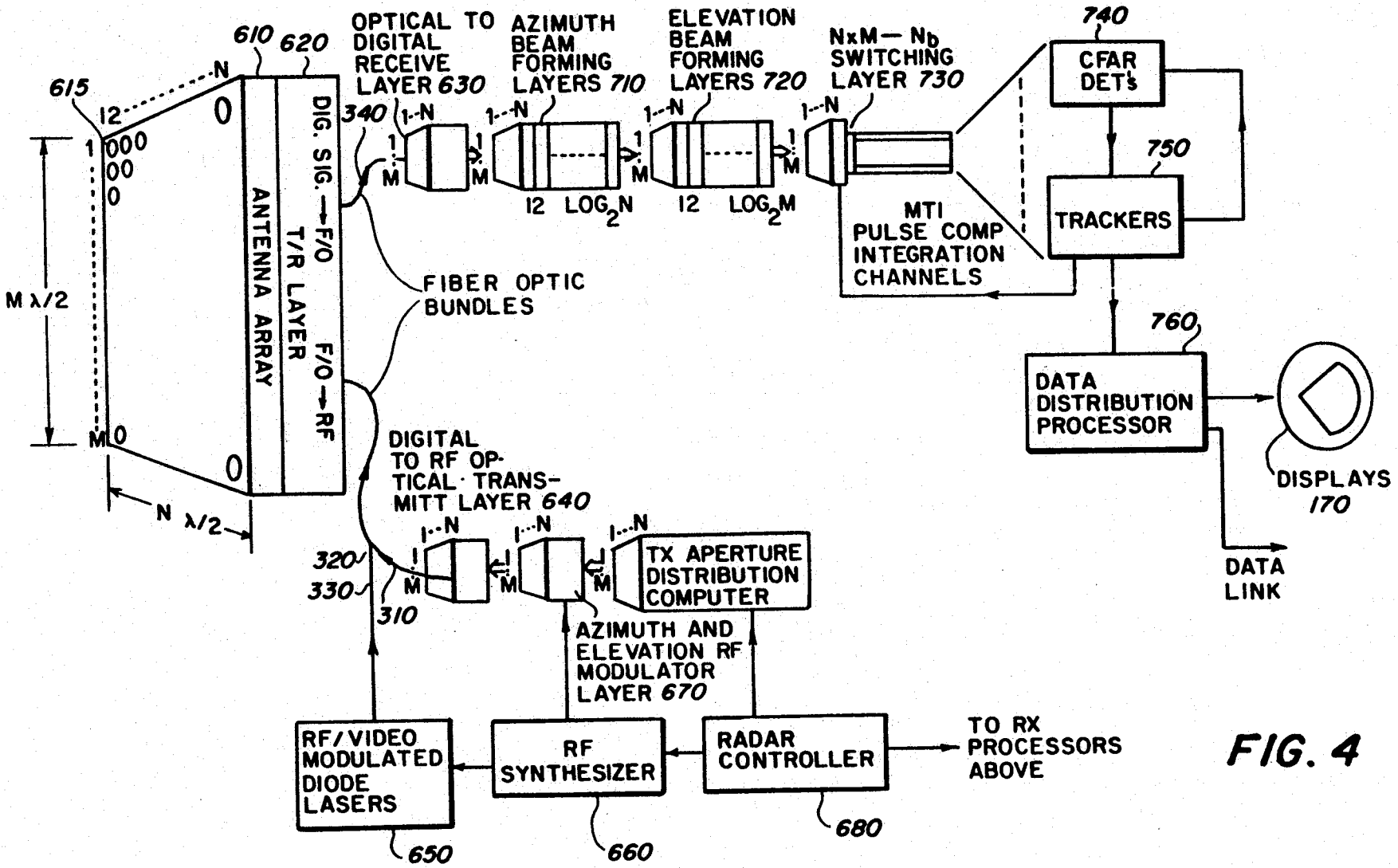
FIG. 4 illustrates an overall system block diagram with a transmit/receive layer connecting an antenna array via fiber optic bundles to a receive layer and a transmit layer coupled to respective beam forming or modulating layers via fiber optic bundles.

FIG. 4 illustrates an overall system block diagram of the layered parallel interface for the antenna array 610. Each antenna element 615 of the antenna array 610 connects via a module of the transmit/receive layer 620 to one set of the optical fibers 310, 320, 330 or 340 in the illustrated fiber optic bundles. A storage element of the optical to digital receive layer 630 connects via optical fibers 340 to the LED digital to optical converters 450 from each module in the transmit/receive layer 620. Furthermore, a digital to RF optical transmit layer 640 connects to optical fibers 310 for the optical to RF converters 280 in each module of the transmit/receive layer 620. Additionally, RF modulated diode lasers 650 connect to the optical fibers 320 and 330 for the optical to RF and optical to video converters 420 and 440 of the transmit/receive layer 620. An individual fiber 320 will be connected from a RF modulated diode laser 650 to each module of the transmit/receive layer. An RF modulated diode laser would transmit a beam to be focused on a set of fibers 320 or 330 by a separate lens system.

In the example of FIG. 2, seven fibers may be used per module. In the example of FIG. 3(*a*), eight modules per fiber are required. Assuming ten fibers per module, an array of 512 antenna elements requires a total of 5,120 optical fibers. Bundles of about one thousand optical fibers are already commercially available, used in medicine to explore inaccessible anatomical regions.

These bundles are only a millimeter or two in diameter. Ribbons rather than bundles of fibers ma also be used having connectors which may be more amenable to a matrix of modules.

An RF/video synthesizer 660 provides control signals to the RF modulated diode laser 650 and an azimuth and elevation RF modulator layer 670 configured adjacent to the digital to RF optical transmit layer 640. The control signals determine an amount of frequency conversion to be performed in the modules of the transmit/receive layer 620 through generation of an intermediate frequency signal. Furthermore, the RF/video synthesizer 660 can generate a clock signal for synchronization of the overall system and control of the analog to digital converters of each module in the transmit/-receive layer 620. A radar controller circuit 680 connects to the RF synthesizer 660 and a transmit aperture distribution computer 690 configured adjacent to the azimuth and elevation RF modulator layer 670. The radar controller 680 also generates control signals to the receive processors which will be described below.

Azimuth beam forming layers 710 and elevation beam forming layers 720 provide an M×N array of receiving beams. The azimuth beam forming layers 710 and the elevation beam forming layers 720 are configured adjacent to the optical to digital receive layers 630. The azimuth beam forming layers 710 and the elevation beam forming layers 720 contain a three-dimensional matrix of compact processors to perform a two dimensional fast Fourier transform. A calculation is performed for each complex digital sample from each module of the transmit/receive layer 620. Real and imaginary parts of each sample are provided alternately by four-bit words from the analog to digital converter 430.

A switching layer 730 is configured adjacent to the azimuth beam forming layers 710 and the elevation beam forming layers 720. The switching layer 730 selects $N_b$ signals from the M×N receiving beams formed by the beamforming processors 710, 720. Processing channels include moving target indicator (MTI) pulse compression and pulse to pulse integration. These channels are connected to constant false alarm detectors 740 and trackers 750. The trackers 750 are connected by feedback to select the appropriate constant false alarm (CFAR) detectors 740 so as to extract data from particular targets. Furthermore, the trackers 750 control the switching layer 730 and provide an output to a data distribution processor 760. Displays 770 connected to an output of the discrimination processor provide a visual representation of targets sensed by the antenna array 610. When using an active phased array which processes all received data with the azimuth and elevation beam forming layers 710 and 720, a number of display formats are appropriate depending on what part of a quarter hemisphere is covered by antenna element patterns, and is illuminated by the radar transmit beam or beams. Four examples (Modes A-D) are discussed in subsequent paragraphs.

Figure 5:
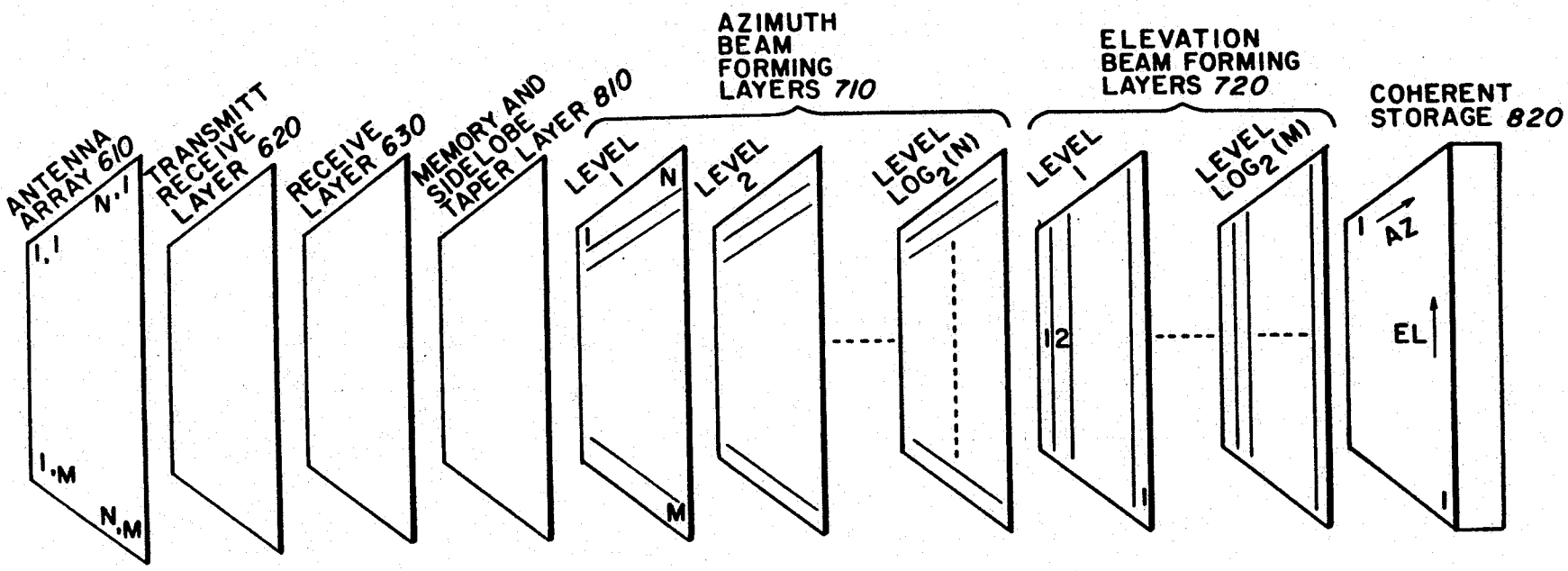
FIG. 5 illustrates adjacent receive and beam forming layers for interface to the antenna elements of an antenna array.

FIG. 5 illustrates the receive processing layers arranged adjacent to one another for processing signals from an antenna array 610 to produce an output image on the display 770. The receive layer 630 is coupled to the transmit/receive layer 620 and the antenna array via the optical fibers. The receive layer 630 is coupled to the azimuth and elevation beam forming layers 710 and 720 by the memory and side lobe taper layer 810. A coherent storage layer 820 of the switching layer 730 receives the output of the azimuth and elevation beam forming layers 710 and 720.

All optical to digital converters in the receive layer 630 simultaneously deliver a complex digital sample to the memory and side lobe taper layer 810. These values must be stored and clocked for receive processing by the azimuth beam forming layers 710 and the elevation beam forming layers 720. This is done in the memory and side lobe taper layer 810. The memory and side lobe taper layer 810 has memory cells corresponding to each antenna element 615. Each memory cell is clocked at the clock frequency by the clock signal. Furthermore, the memory and side lobe taper layer 810 performs side lobe tapering of the signal from each antenna element 615. Memory cell layers preferably are also provided between each of the azimuth beam forming layers 710 and the elevation beam forming layers 720.

The azimuth beam forming layers 710 have a number of layered levels adjacent to one another. The number of layered levels is equal to a base two logarithm of a number of columns N of the antenna elements in the antenna array 610 $LOG_2(N)$. Furthermore, the elevation beam forming layers 720 have a number of layered levels. The number of layered levels of elevation beam forming layers is equal to a base two logarithm of a number of rows M of the antenna elements 615 in the antenna array 610 $LOG_2(M)$. Each layered level of the azimuth and elevation beam forming layers 710 and 720 has an array of processors. To perform the fast Fourier transform, each processor performs a butterfly operation on each pair of signals from the antenna elements 615 from the antenna array 610. The butterfly operation in each processor can be performed, for example, by preferably a TRW TMC-2249 integrated circuit. A matrix of these integrated circuit chips can be built, for example, using wafer scale integration of a plurality of these chips. Layers of these matrices of chips can then be stacked one atop another to perform the multilevel processing. Memory layers having memory cells sandwiched between the layers of processor chips are also preferred. To perform the fast Fourier transform for each antenna element 615 with respect to all remaining antenna elements, the outputs of one processor must be connected to particular inputs to processors in the next layer. Furthermore, the processors must be connected in a reliable and compact fashion. The processors can be, for example, in layers stacked next to adjacent layers. Alternatively, for example, each layer of processors can be an individual circuit board plugged into a black plane of a circuit board rack.

Figure 6A:
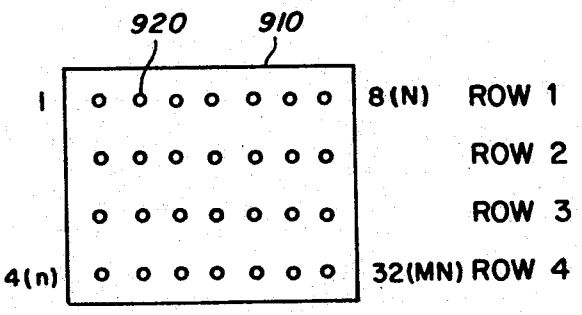
FIG. 6(*a*) illustrates an exemplary number of rows and columns in an antenna array.
Figure 6B:
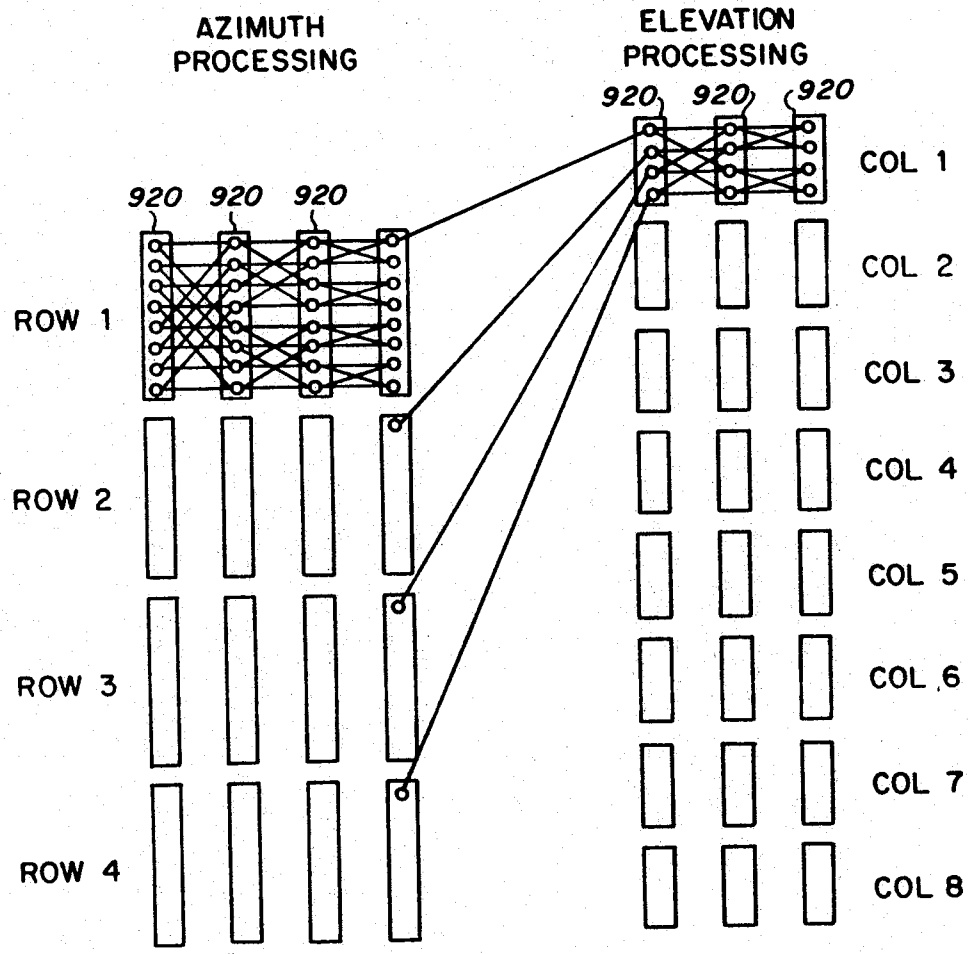

FIG. 6(*a*) illustrates the relationship for the processors of the azimuth and elevation beam forming layers 710 and 720 for an exemplary antenna array 910 having N×M antenna elements where N =8 columns and M=4 rows. Therefore, the example antenna array 910 of FIG. 6(*b*) has 32 antenna elements which are processed in 4 rows and 8 columns as illustrated in FIG. 6(*b*). Each row of nodes 920 illustrated in FIG. 6(*a*) corresponds to an interface between layers. Therefore, three azimuth processing layers ($LOG_2(8)=3$) and two elevation processing layers ($LOG_2(4)=2$) are needed.

Figure 7:
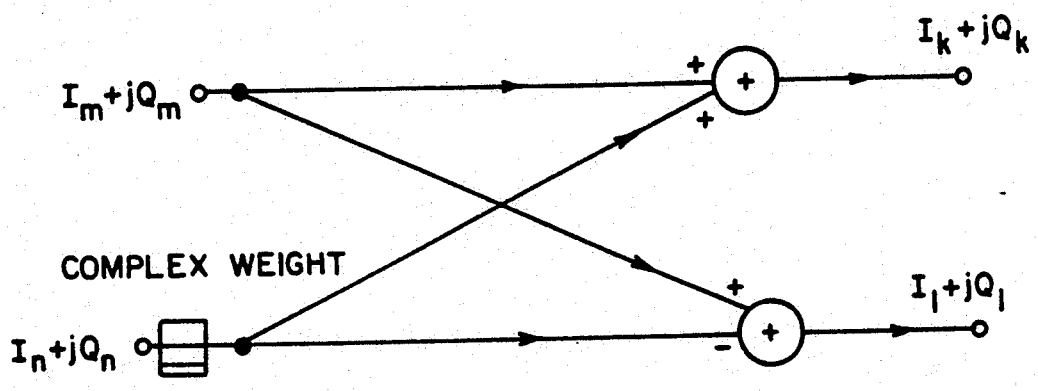
FIG. 7 illustrates a butterfly operation performed by processors of the beam forming layers.

FIG. 7 illustrates the butterfly operation between two inputs at nodes 920 and two outputs at nodes 920. Therefore, it is apparent that the butterfly operation requires a pair of inputs and delivers a pair of outputs for each layer of processing. Each butterfly processor 930 converts an input pair composed of a first complex input $I_m+jQ_m$ and a second complex input $I_n+jQ_n$ by multiplying the second complex input $I_n+jQ_n$ by a complex weight and then summing the first complex input and the weighted second complex input to produce a first complex output $I_k+jQ_k$ of an output pair. Furthermore, the weighted second complex input $I_n+jQ_n$ is subtracted from the first complex input $I_m+jQ_m$ to produce a second complex output $I_l+jQ_l$ of the output pair as illustrated in FIG. 7. Because the clock control signal (sampling rate) has a frequency of, for example, 300 KHz, the signals propagate through each of the processing layers, one layer every 3⅓ μs. Thus, the signals propagate out of the optical fibers 340, through the optical to digital converters of the receive layer 630 and into memories of the memory and side lobe taper layer 810. Thereafter, they are clocked through the azimuth and elevation beam forming layers 710 and 720, one layer every 3.3 μs. Therefore, in the 8×4 array of FIG. 6(*b*), 16.67 μs (5 layers×3.3 μs) is the azimuth and elevation beam forming delay. The data throughput rate is not affected by the layered structure of the present invention. Rather, only this delay is needed to process the signals through all of the layers.

In the example of FIG. 6(*b*), each layer requires sixteen butterfly processors because each butterfly processor can process two inputs at the nodes 920. Therefore, azimuth and elevation processing requires 5×16=80 butterfly processors. Since the TRW TMC-2249 can perform one operation in less than 0.1 μs, then sixteen butterflies in parallel will perform a row of processing (N=32 in FIG. 5) under 0.1 μs. Thus, the same sixteen butterfly processors can complete sixteen rows (M=16 in FIG. 5) of samples in 1.6 μs—less than half the time between consecutive time samples. Therefore, the TRW TMC-2249 chip Would suffice as is; faster and more suitable butterfly processors can be fabricated or discovered for use in the azimuth and elevation beam forming layers 710 and 720. For example, a custom integrated circuit or wafer scale integration layer can be fabricated using photolithographic techniques and semiconductor processing.

When memory planes are sandwiched between each azimuth and beam forming layer 710 or 720 (FIG. 5), then the samples from an entire 512 element array (16 rows of 32 columns) may be converted to 16 sets of azimuth beam samples in 1.6 μs plus small delays from shifting results of the butterfly operations in each layer to inputs of the next layer. For five stages this delay should be less than 1 μs. Hence, the 512 azimuth beam samples from the fifth azimuth beam forming fast Fourier transform layer should be ready for elevation beam forming before another set of 512 complex values arrives at the first layer. Thus, the beam forming processors easily keep up with all 512 antenna elements, each of which yields complex values at 300 KHz (512 new values every 3.33 μs).

A 16-point fast Fourier transform must be performed for each column (16 values) provided by the azimuth beam forming layers 720. Four layered levels are required and eight butterflies are needed per layered level. Since each butterfly processor requires 0.1 μs, 3.2 μs are needed to sequentially process 32 columns. Again, this is less than the 3.33 μs interval required between sets of 512 samples from the azimuth beam forming layers 710. Hence, processing will keep pace with the 300 KHz clock signal and the result of elevation beam forming will be a set of 512 samples from 512 pencil beams recurring at 300 KHz.

In the present example of the invention, peak/average power assumptions ($P_t$=260 Kw peak, 11 KW average) implies a module which radiates 508 watts peak, 21 watts average. The array gain of 31 dB implies that the element gain equals about 4 dB which is consistent with the 90°×90° element pattern.

Several modes of possible operation will be discussed based upon an L-band example defined by the assumptions listed in the following Table I:

TABLE I

| | |
|---|---|
| Wavelength (feet) | 1.0 feet |
| Pt (KW) (peak/av) | 260/11 |
| G (dB) | 31 |
| Element pattern (deg) | 90° × 90° |
| Array Configuration | 32 az/16 el (20 × 10 feet) |
| Pulse Width (μs) | 50 |
| PRF (pps) | 800 |
| Noise Figure (dB) | 3 |
| SNR (.9, E-6, NCI-125, SW2) | −1 dB |
| Doppler Filtering (Modes A and D) | 64 pulse FFT |

Mode A: radiation into a single beam for 10 seconds (burn-through mode). A 64 point fast Fourier transform coherently integrates over 0.08 seconds and 125 groups are non-coherently integrated over the 10 second processing time.

Mode B: radiation into a single beam which is scanned over 90° azimuth dwelling on each of 32 receive beam positions for 0.04 seconds which is sufficient for 32 point Doppler filtering. This is then repeated at a higher elevation angle for another 1.28 seconds to obtain some vertical coverage; non-coherent integration over 10 scans is assumed.

Mode C: radiation into a single beam which dwells at each beam position in the 90° azimuth sector for 0.02 seconds (a 16 point fast Fourier transform). In this case, the azimuth scan is repeated at 4 elevation angles without scan-to-scan integration.

Mode D: radiation into a fan 90° wide in azimuth. This may be accomplished by azimuth-focussing along a line about ten feet from the twenty foot array Elevation focussing is at infinity and phasing splits transmit gain between two elevation angles. A 64 point processing operation is simultaneously performed on all signals received by all 32 horizon beams and all 32 elevated beams requiring 80 milliseconds. Non-coherent integration of ten groups of Doppler data consumes a total of 0.8 seconds.

Performance for each of these four modes A, B, C and D, dependent upon the parameters in the above Table I, are listed below in Table II assuming target cross-section equals one square meter:

TABLE II

| | |
|---|---|
| Mode A | 759 nautical miles |
| Mode B | 443 nautical miles |
| Mode C | 170 nautical miles |
| Mode D | 223 nautical miles |

This performance in Table II is taken when average power is chosen to be typical of existing conventional search radars. Because of the fourth power dependence of required average power on range, the range of the Mode A would equal 200 nautical miles even if Pav=53 watts. The ranges of Modes B, C and D would scale by the same factor.

While the invention has been illustrated, described, and detailed in the drawings and foregoing descriptions, it will be recognized that many changes and modifications will occur to those skilled in the art. It is therefore intended, by the appended claims, to cover any such changes and modifications which fall within the true spirit and scope of the invention.

What is claimed is:

1. An interface to couple an array of antenna elements to a bundle of optical fibers, comprising:

a transmit receive layer having an array of transmit receive modules, each of said transmit receive modules associated with one of the antenna elements and comprising:

an analog to digital converter operatively connected to convert an RF receive signal from an associated antenna element to a predetermined number of receive signal bits;

at least one digital to optical converter coupled between one of the optical fibers and said analog to digital converter to convert one of the receive signal bits to an optical receive signal; and a transmit amplitude modulated optical to RF converter coupled between one of the optical fibers and the associated antenna element to convert an amplitude modulated optical transmit signal to an RF transmit signal;

a receive layer operatively connected to a predetermined portion of the optical fibers and comprising an array of receive optical to digital converters, each of the receive optical to digital converts connected to an associated one of the antenna elements; and a plurality of digital azimuth beam forming layers and digital elevation beam forming layers, each layer having a like number of inputs and outputs, wherein adjacent layers are connected to one another and an end layer of said beam forming layers is connected to said receive layer.

2. An interface according to claim 1, wherein each of said transmit receive modules further comprises a frequency down converter operatively connected between an associated antenna element and said analog to digital converter to down convert a frequency of received energy from the associated antenna element; and wherein said transmit receive layer further comprises a reference frequency optical to RF converter coupled between an optical fiber and said frequency down converter.

3. An interface according to claim 2, wherein each of said transmit receive modules further comprises:

a receive amplifier operatively connected to said frequency down converter to amplify the RF signal; and a transmit amplifier operatively connected to said transmit optical to RF converter to amplify the RF transmit signal.

4. An interface according to claim 2, wherein each of said transmit receive modules further comprises a frequency up converter operatively connected to said transmit amplitude modulated optical to RF converter to up convert a frequency of the RF transmit signal; and wherein said transmit receive layer further comprises a reference frequency optical to RF converter coupled between an optical fiber and said frequency up converter to provide a reference frequency control signal to said reference frequency optical to RF converter.

5. An interface according to claim 1, wherein a clock signal optical to video converter is operatively connected to one of the optical fibers to provide a clock signal to said analog to digital converter.

6. An interface according to claim 1, wherein each of said transmit receive modules further comprises:

a microstrip element configured orthogonal to a slot of an associated antenna element and coupled between said transmit optical to RF converter and said analog to digital converter.

7. An interface according to claim 1, further comprising:

a transmit layer operatively connected to a predetermined portion of the optical fibers, said transmit layer comprising an array of transmit RF to optical converters, each of the transmit RF to optical converters associated with one of the antenna elements; and at least one control RF to amplitude modulated optical converter operatively connected to at least one of the optical fibers.

8. An interface according to claim 7, further comprising:

an azimuth and elevation RF modulator layer operatively connected to said receive layer and comprising an array of azimuth and elevation modulator modules, each of the azimuth and elevation modulator modules being associated with one of the antenna elements.

9. An interface according to claim 7, further comprising:

a receive layer operatively connected to a predetermined portion of the optical fibers and comprising an array of receive optical to digital converters, each of the receive optical to digital converters associated with one of the antenna elements.

10. An interface according to claim 1, wherein each of said digital azimuth and digital elevation beam forming layers has an array of digital processing modules connected to digital processing modules of adjacent beam forming layers to receive and process beam information represented by digital complex numerical values; and wherein each said processing module comprises a butterfly operation processor connected to perform a butterfly operation on a pair of digital complex numerical values provided from two adjacent processing modules.

11. An interface according to claim 10, wherein said plurality of beam forming layers comprises:

azimuth beam forming layers provided in a number equal to a base two logarithm of a number of columns of the antenna elements in the array of antenna elements; and elevation beam forming layers provided in a number equal to a base two logarithm of a number of rows of columns of the antenna elements in the array of antenna elements.

12. An interface according to claim 1, wherein said azimuth beam forming layers are provided in a number equal to a base two logarithm of a number of columns of the antenna elements in the array of antenna elements; and wherein said elevation forming layers are provided in a number equal to a base two logarithm of a number of rows of the antenna elements in the array of antenna elements.

13. An interface according to claim 1, wherein each of said digital azimuth and digital elevation beam forming layers has an array of digital processing modules connected to digital processing modules of adjacent beam forming layers to receive and process beam information represented by digital complex numerical values; and wherein said processing modules are connected to processing modules in adjacent digital azimuth and elevation beam forming layers such that said digital azimuth and elevation beam forming layers perform a two dimensional Fourier transform.

14. An interface according to claim 10, further comprising:

a transmit layer operatively connected to a predetermined portion of the optical fibers, said transmit layer comprising an array of transmit RF to optical converters, each of the transmit RF to optical converters associated with one of the antenna elements; and at least one control RF amplitude modulated optical converter operatively connected to at least one of the optical fibers.

15. An interface according to claim 14, further comprising:

an azimuth and elevation RF modulator layer operatively connected to said receive layer and comprising an array of azimuth and elevation modulator modules, each of the azimuth and elevation modulator modules being associated with one of the antenna elements.

16. An interface according to claim 15, wherein each of said transmit receive modules further comprises a frequency up converter operatively connected to said transmit amplitude modulated optical to RF converter to up convert a frequency of the RF transmit signal; and wherein said transmit receive layer further comprises a reference frequency optical to RF converter coupled between an optical fiber and said frequency up converter to provide a reference frequency control signal to said reference frequency optical to RF converter.

17. An interface according to claim 10, wherein each of said transmit receive modules further comprises a frequency down converter operatively connected between an associated antenna element and said analog to digital converter to down convert a frequency of received energy from the associated antenna element; and wherein said transmit receive layer further comprises a reference frequency optical to RF converter coupled between an optical fiber and said frequency down converter.

18. An interface according to claim 17, wherein said processing modules of each digital azimuth beam forming layer and each digital elevation beam forming layer are provided in a number equal to the number of antenna elements in the array of antenna elements.

19. An interface according to claim 10, wherein said processing modules of each digital azimuth beam forming layer and each digital elevation beam forming layer are provided in a number equal to the number of antenna elements in the array of antenna elements.

20. An interface according to claim 1, wherein said processing modules of each digital azimuth beam forming layer and each digital elevation beam forming layer are provided in a number equal to the number of antenna elements in the array of antenna elements.

* * * * *